US005735017A

United States Patent [19]

Barnes et al.

[11] Patent Number: 5,735,017

[45] Date of Patent: Apr. 7, 1998

[54] COMPACT WET/DRY VACUUM CLEANER WITH FLEXIBLE BLADDER

[75] Inventors: James F. Barnes, Anderson; Michael D. Bartlett, Pickens; Martin E. Harbeck; Marion C. Johnson, both of Anderson, all of S.C.

[73] Assignee: Bissell Inc., Grand Rapids, Mich.

[21] Appl. No.: 624,242

[22] Filed: Mar. 29, 1996

[51] Int. Cl.[6] ..... A47L 9/10

[52] U.S. Cl. ..... 15/321; 15/328; 15/353

[58] Field of Search ..... 15/321, 328, 353, 15/320

[56] References Cited

U.S. PATENT DOCUMENTS

| | | | |
|---|---|---|---|
| 3,034,273 | 5/1962 | Wallace . | |
| 3,040,362 | 6/1962 | Krammes | 15/342 |
| 3,056,994 | 10/1962 | Noble . | |
| 3,117,337 | 1/1964 | Krammes . | |
| 3,180,071 | 4/1965 | Nolte | 15/328 X |
| 3,343,199 | 9/1967 | Nolte . | |
| 3,896,520 | 7/1975 | Williams . | |
| 4,151,627 | 5/1979 | Wisdom | 15/321 |
| 4,167,800 | 9/1979 | Tribolet | 15/353 X |
| 4,196,492 | 4/1980 | Johnson et al. . | |
| 4,200,951 | 5/1980 | Burgoon et al. | 15/321 |
| 4,210,978 | 7/1980 | Johnson et al. . | |
| 4,287,635 | 9/1981 | Jacobs | 15/321 |
| 4,314,385 | 2/1982 | Wimsatt et al. . | |
| 4,466,155 | 8/1984 | Grave . | |
| 4,586,208 | 5/1986 | Trevarthen | 15/321 X |
| 4,667,364 | 5/1987 | Meli . | |
| 4,956,891 | 9/1990 | Wulff . | |
| 5,237,719 | 8/1993 | Dwyer et al. | 15/320 X |
| 5,287,587 | 2/1994 | Yonkers et al. . | |
| 5,526,547 | 6/1996 | Williams et al. | 15/320 |

*Primary Examiner*—Chris K. Moore

*Attorney, Agent, or Firm*—Rader, Fishman, Grauer & Mc Garry

[57] ABSTRACT

A vacuum cleaner for cleaning a surface is disclosed. The vacuum cleaner comprises a main housing including a tank chamber, a motor-blower assembly for creating a vacuum, a recovery tank disposed within the tank chamber for storing contaminated liquid, a supply tank for providing cleaning liquid, a hose assembly and a fluid pump. The fluid pump pumps fluid from the supply tank onto a surface to be cleaned. The vacuum pump creates a vacuum across the recovery tank assembly and hose assembly to vacuum up dispensed cleaning fluid into the recovery tank assembly. Preferably, the supply tank may be a flexible bladder disposed within the recovery tank. The flexible bladder contracts as liquid is dispensed so that the volume for storing contaminated liquid within the recovery tank assembly increases. Preferably, the recovery tank may be removed from the main housing and a vacuum bag is fluidly connected between the hose assembly and the motor-blower assembly for dry vacuuming.

16 Claims, 7 Drawing Sheets

COMPACT WET/DRY VACUUM CLEANER WITH FLEXIBLE BLADDER

TECHNICAL FIELD

The present invention relates to wet/dry vacuum cleaners.

BACKGROUND OF THE INVENTION

Combination wet/dry vacuum cleaners traditionally have a single storage tank for receiving and storing either liquid or dry debris vacuumed from a surface. The storage tank receives contaminated liquid in a wet vacuuming mode or else dry debris in a dry vacuuming mode. When the storage tank is full, the storage tank is removed from the rest of the vacuum cleaner, dumped, and reunited with the vacuum cleaner.

In some instances, the storage tank is removable from within a main housing of the vacuum cleaner. In others, the bottom half of the vacuum cleaner is a pail on casters and serves as the main housing for the vacuum cleaner. A cover with a vacuum pump mounted thereon then attaches to the pail-like bottom half or housing.

In other vacuum cleaners, such as carpet shampooers, a separate supply tank is disposed within the vacuum cleaner to provide a cleaning liquid. The cleaning liquid is dispensed upon a surface to be cleaned. The sprayed liquid and contaminants therein are then vacuumed up and collected in a separate recovery or storage tank.

Each of these types of vacuum cleaners has drawbacks. First, vacuum cleaners using separate liquid supply and recovery tanks can be bulky. Sufficient storage space must be provided for both the clean liquid supply tank and the recovery tank within the housing of the vacuum cleaner.

A drawback of conventional wet/dry vacuum cleaners is that simply using a single storage tank is not as effective as using a storage tank with a separate vacuum bag during dry vacuuming. Moreover, these vacuum cleaners do not enjoy the advantage of providing an onboard cleaning liquid or solvent to assist in removing dirt from a surface such as soiled carpet.

The present invention is intended to overcome problems of excessive vacuum cleaner housing size requirements and inefficient filtration of air during dry vacuuming encountered with previous vacuum cleaners.

SUMMARY OF THE INVENTION

The present invention is directed to a vacuum cleaner. The vacuum cleaner includes a main housing, a motor-blower assembly, a recovery tank assembly, a hose assembly and a fluid pump. A tank chamber is formed in the main housing into which the recovery tank assembly resides. The recovery tank assembly includes a recovery tank and a flexible bladder. The hose assembly includes a vacuum hose and a fluid dispensing conduit for dispensing cleaning liquid on to a floor surface. The fluid pump is in fluid communication with either the flexible bladder or the recovery tank to pump fluid therefrom to the liquid dispensing conduit. The other of the flexible bladder and the recovery tank is in fluid communication with the vacuum hose and motor-blower assembly so that the vacuum hose may vacuum liquid from the floor surface and into the other of the flexible bladder and the recovery tank. Ideally, the recovery tank may be removed from the tank chamber of the main housing. A vacuum bag may then be placed in the tank chamber which is fluidly interposed between the motor-blower assembly and the vacuum hose assembly so that dry vacuum be accomplished.

Further, it is desirable to connect the hose assembly to the main housing using a swivel connection. The swivel connection includes an inlet tube and a dispensing tube for fluidly connecting the respective vacuum hose and dispensing conduit to the tank chamber and motor-blower assembly and to the fluid pump and supply of cleaning liquid.

It is an object of the present invention to minimize overall tank and housing size requirements in a wet/dry vacuum cleaner by providing a flexible bladder within an outer storage tank, the flexible bladder contracting in volume as it is emptied of liquid to provide more recovery room in the outer tank as contaminated cleaning liquid is accumulated therein.

It is yet another object to provide a vacuum cleaner which may alternatively use a vacuum bag for dry vacuuming or else a removable liquid storage tank during wet vacuuming which selectively reside in the same tank chamber of a vacuum cleaner housing.

Still yet another object is to provide a swivel plate including vacuum inlet tube and a fluid dispensing tube, the swivel plate fluidly connecting to a vacuum hose and a dispensing hose of a hose assembly.

BRIEF DESCRIPTION OF THE DRAWINGS

These and other features, objects, and advantages of the present invention will become readily apparent from the following description, pending claims, and accompanying sheets of drawings where:

BEST MODE FOR CARRYING OUT THE INVENTION

Figure 1:
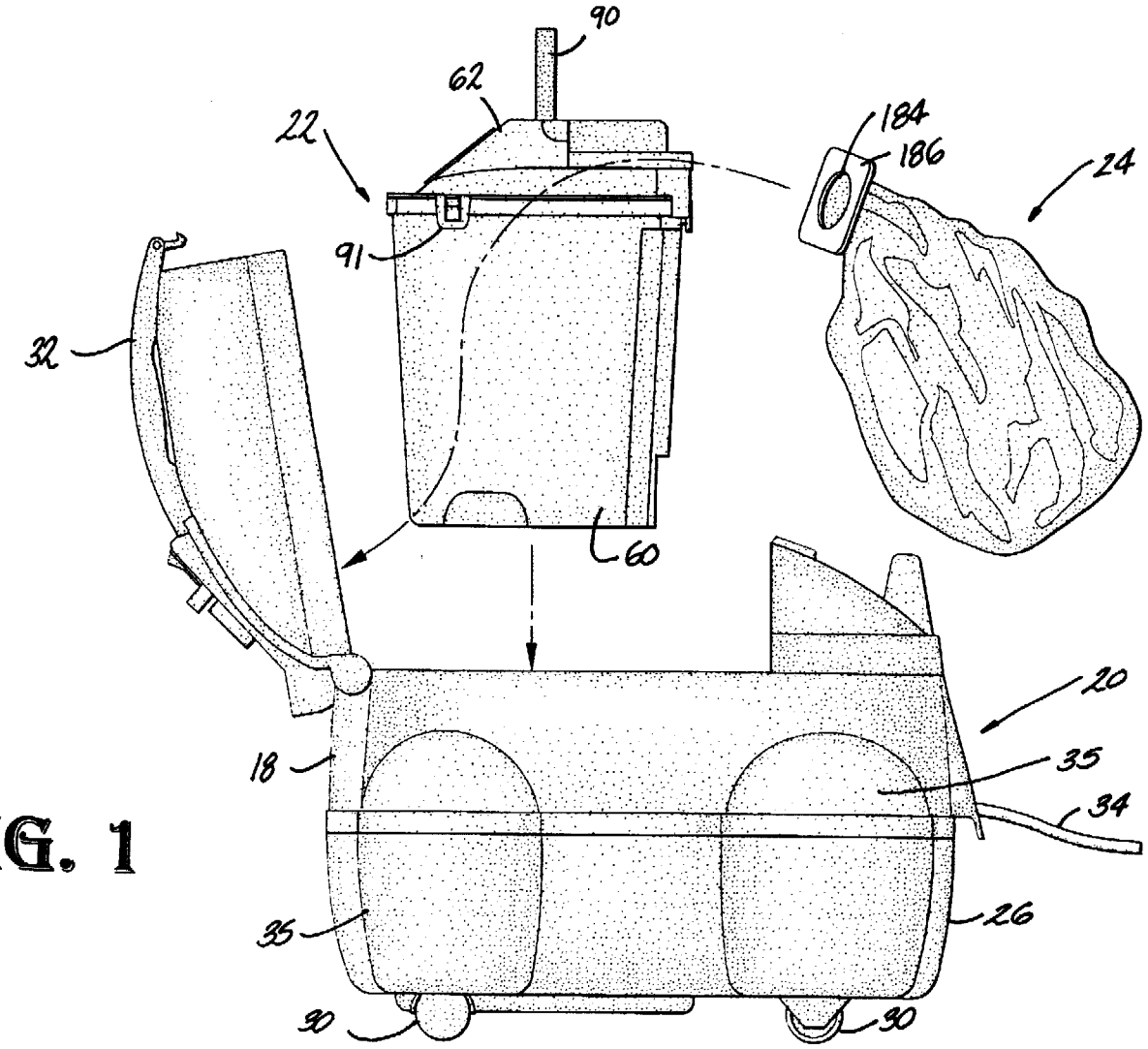
FIG. 1 is a side view of a body of a wet/dry vacuum cleaner, made in accordance with the present invention, having a cover assembly pivoted open and ready to selectively receive either a recovery tank assembly with a flexible bladder therein or else a vacuum bag.

FIG. 1 shows the body 18 of a wet/dry vacuum cleaner 20, made in accordance with the present invention. Vacuum cleaner 20 can be selectively used in either a wet vacuuming mode or a dry vacuuming mode. In the case of the wet vacuuming mode, a recovery tank assembly 22 is installed into the vacuum cleaner 20. Alternatively, when vacuum cleaner 20 is used in a dry vacuuming mode, a conventional air permeable vacuum bag 24 replaces recovery tank assembly 22. The major components and general operation of vacuum cleaner 20 will first be described. Then the individual components will be described in greater detail.

Body 18 comprises a main housing 26 mounted upon casters 30 and a hinged cover assembly 32 pivotally mounted upon main housing 26. Recovery tank assembly 22 is held within main housing 26 and is interchangeable with vacuum bag 24. A power cord 34 provides power to vacuum cleaner 20. The exterior surface of vacuum cleaner 20 is rounded having a domed-shaped top and four bulbous corners 35.

Figure 2:
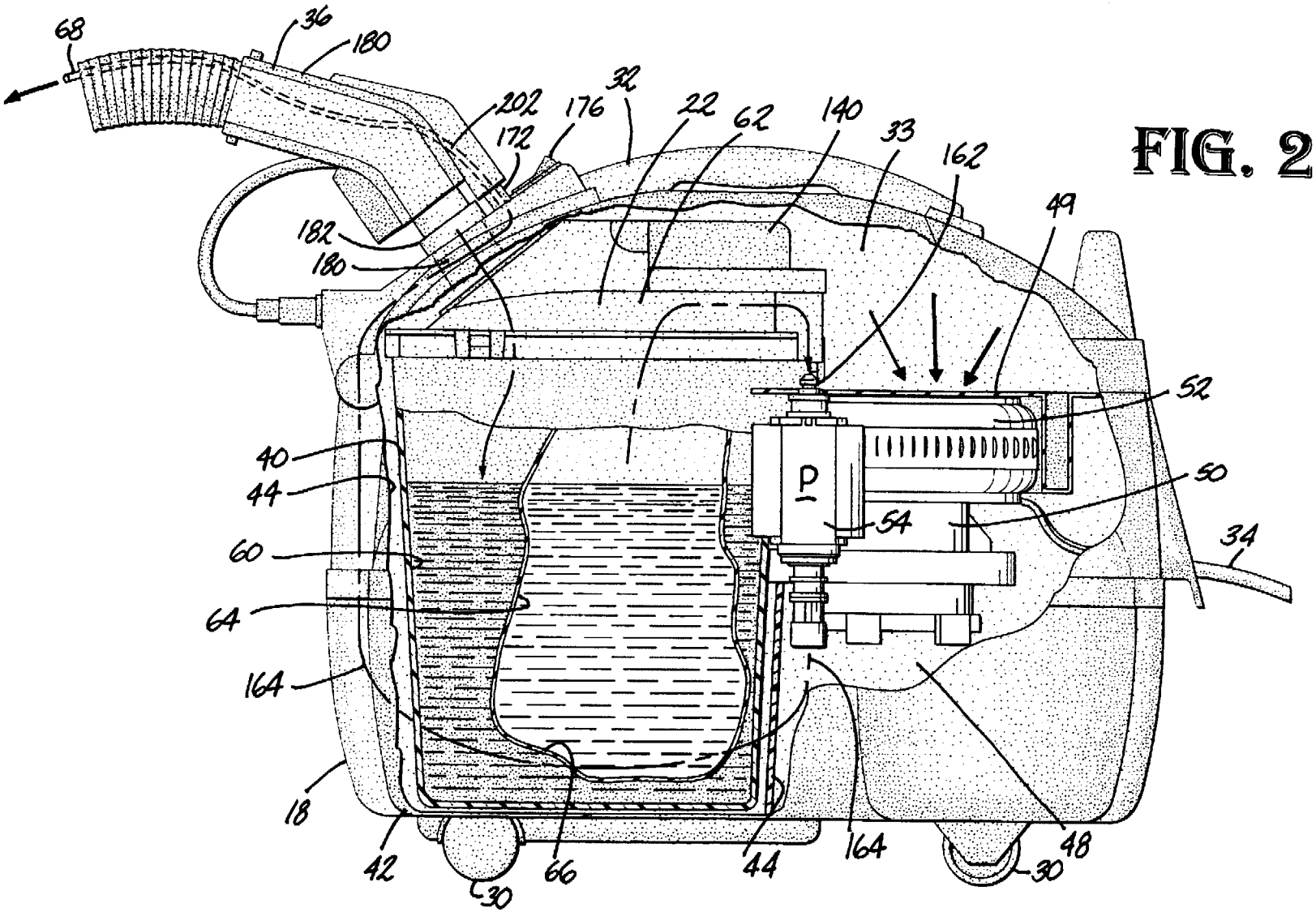
FIG. 2 is a fragmentary side view, partially broken away, showing internal components of the vacuum cleaner.

FIG. 2 shows a fragmentary view of vacuum cleaner 20 with optional recovery tank assembly 22 installed within main housing 26. Mounted to the top of cover assembly 32 is a hose assembly 36. A cover chamber 33 is defined between the underside of cover assembly 32 and main housing 26. Formed within main housing 26 is a tank receiving chamber 40 which is contoured to receive either recovery tank assembly 22 (as shown) or else vacuum bag 24. Tank receiving chamber 40 includes a floor 42 and four peripherally extending and contoured vertical side walls 44. Also located within main housing 26 is a separate motor and pump chamber 48 which is separated from tank chamber 40 by one of side walls 44. Chamber 48 is open (not shown) to the environment on its bottom and has a top wall 49.

A motor 50 and blower assembly 52 are suspended from top wall 49 of housing 26 within chamber 48. Blower assembly 52 is in fluid communication with cover chamber 33 as indicated by the arrows in FIG. 2. Air passing through blower assembly 52 exhausts out through the bottom opening of chamber 48. A fluid pump 54 is suspended from main housing 26 and is used to pump liquid stored in vacuum cleaner 20 onto a surface to be cleaned.

Figure 3:
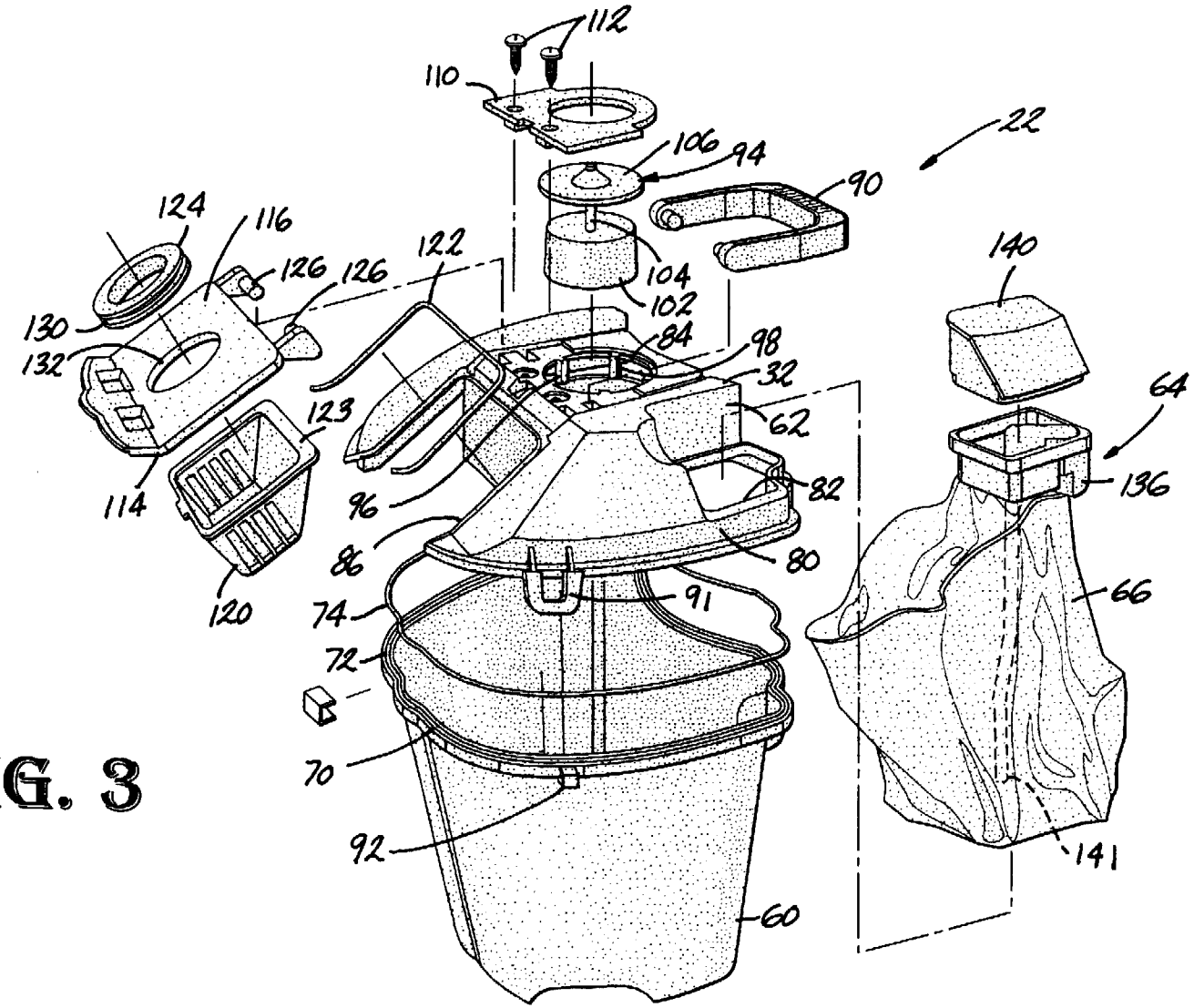
FIG. 3 is an exploded perspective view of a recovery tank assembly including a flexible bladder.

Recovery tank assembly 22 is best seen in FIG. 3. Recovery tank assembly 22 includes a generally rigid plastic recovery tank 60 and a recovery tank cover assembly 62 which sealingly mounts upon recovery tank 60. A flexible bladder assembly 64, including a flexible bladder 66, is suspended from cover assembly 62. Recovery tank assembly 22 will be described in greater detail later.

Referring back to FIG. 2, in operation, flexible bladder 66 is initially filled with a cleaning solution or liquid. When full, flexible bladder 66 will occupy most of the volume within recovery tank 60. During a wet vacuuming mode, fluid pump 54 is activated and draws liquid from flexible bladder 66 and delivers the liquid to hose assembly 36 along a pathway schematically illustrated in FIG. 2. A dispensing conduit 68 receives and carries the cleaning liquid through hose assembly 36 to a floor or surface to be cleaned. A dispensing valve (not shown) on a distal end of hose assembly 36 controls the spraying of cleaning liquid onto a floor surface.

Concurrently, motor 50 is activated to drive blower assembly 52. As a result, a vacuum is placed across cover chamber 33. Recovery tank assembly 22 is in fluid communication with cover chamber 33 and hose assembly 36. The vacuum in cover chamber 33 thus produces a similar vacuum in recovery tank assembly 22 and hose assembly 36. This vacuum induces air and contaminated cleaning liquid, which was previously expelled on to the floor surface to be cleaned, to be drawn into hose assembly 36. The air and entrained cleaning liquid and debris pass through hose assembly 36 and are collected into recovery tank 60 outside flexible bladder 66.

As this liquid dispensing and recovery operation continues, liquid is drawn from flexible bladder 66, passes to fluid pump 54 and is expelled out through hose assembly 36 onto a surface to be cleaned. Then the contaminated cleaning liquid is picked up by hose assembly 36 and is increasingly accumulated in recovery tank 60 outside flexible bladder 66. The amount of liquid in and the size of flexible bladder 66 decreases to accommodate the increasing storage space requirements in recovery tank 60 surrounding flexible bladder 66 as liquid is transferred therebetween. By employing flexible bladder 66 within recovery tank 60, the need for a tank chamber sufficiently voluminous to store two separate rigid liquid tanks, each of which is of sufficient size to hold the entire volume of cleaning liquid, is eliminated. Accordingly, vacuum cleaner 20 can be made in a more compact fashion by employing flexible bladder 66 within recovery tank 60 than are conventional wet cleaning vacuum cleaners which carry their own supply of cleaning liquid.

In the event that a user chooses to utilize a dry vacuuming mode rather than the wet vacuuming mode, cover assembly 32 is pivotally opened relative to main housing 26 with hose assembly 36 fluidly disconnecting from recovery tank assembly 22. At this time, recovery tank assembly 22 can be removed from tank chamber 40 and any stored contaminated liquid therein can be poured out of recovery tank assembly 22.

Then a vacuum bag 24 is fluidly connected to the underside of cover assembly 32 and hose assembly 36. Cover assembly 32 is closed with vacuum bag 24 being disposed within tank receiving chamber 40 in the space previously occupied by storage tank 60. As fluid pump 54 is no longer needed, fluid pump 54 is turned off throughout dry cleaning mode use. Activating motor 50 and blower assembly 52 causes a vacuum to be placed across cover chamber 33 and tank chamber 40. As vacuum bag 24 is air permeable, air and debris are then drawn into hose assembly 36 and collected within vacuum bag 24. Air is filtered through pores in vacuum bag 24, passing into tank chamber 40 and cover chamber 33. This filtered air then passes through blower assembly 52 into chamber 48 exiting vacuum cleaner 20 through the open bottom of chamber 48.

Individual components of vacuum cleaner 20 and connections therebetween will now be described in greater detail. FIG. 3 depicts recovery tank assembly 22 with bladder assembly 64 disposed therein. Recovery tank 60 is made of a moldable plastic, is generally cylindrical in shape and is contoured to match the inside of tank chamber 40. An opening 70 is formed at the top of recovery tank 60. Opening 70 includes a peripherally extending U-shaped groove 72 which receives an elastomeric seal 74.

Recovery tank cover assembly 62 mounts upon recovery tank 60 sealingly capturing elastomeric seal 74 therebetween. Recovery tank cover assembly 62 includes a main cover body 80 which is somewhat domed shaped. Cover body 80 has numerous openings including a bladder receiving opening 82, a circular float opening 84 and a hose inlet opening 86. A cup 87 extends downwardly from float opening 84 and supports a float assembly 94 therein.

A handle 90 pivotally secures within opposed pin recesses in cover body 80 so that recovery tank assembly 22 can be lifted from and installed in tank chamber 40 as needed. Circumferentially located along the lower periphery of cover body 80 are four hooks 91 which can be snapped over four respective prongs 92 (one of which is shown) which are disposed circumferentially along the outside upper periphery of recovery tank 60.

Float assembly 94 is suspended from cover body 80 in cup 87. Float assembly 94 includes a cylindrical foam body 102, a stem 104 extending upwardly therefrom and connecting to a disc-shaped valve body 106. A mounting plate 110 includes a couple of holes for receiving fasteners 112 which are used to secure float assembly 94 to cover body 80. Valve body 106 is slidably captured in cup 87 beneath mounting plate 110. If excessive foam builds up within recovery tank 60, the excessive foam will lift foam body 102 upwardly causing valve body 106 to rise and seal against the bottom side of mounting plate 110. This seal shuts off the air passageway between blower assembly 52 and recovery tank assembly 22. Consequently, foam cannot escape out through float opening 84 and pass to motor and pump recess 48 and out onto the floor surface with exhaust air from blower assembly 52.

Hose inlet opening 86 permits air from hose assembly 36 to enter recovery tank assembly 22. An inlet strainer assembly 114 is mounted over inlet opening 86. Inlet strainer assembly 114 includes a cover plate 116, a perforated strainer basket 120, a U-shaped seal member 122 and an annular elastomeric seal ring 124. Cover plate 116 is provided with a pair of hinge pins 126 which hingedly attach to main cover body 80. Seal 122 is captured between inlet opening 86 on cover body 80 and a rectangular flange 123 formed on the top of perforated basket 120. Perforated basket 120 clips beneath cover plate 116 and serves to catch large foreign objects so that they do not pass into recovery tank 60. Incoming air strikes the back wall of basket 120 causing liquid and debris to lose energy and fall to the bottom of recovery tank 60. Seal ring 124 has an annular radially outwardly opening groove 130 which sealingly mates with an aperture 132 in the center of cover plate 116. Cover plate 116 swings open to allow liquid to be poured from recovery tank 60 when recovery tank assembly 22 is removed from vacuum cleaner 20.

Flexible bladder assembly 64 comprises flexible bladder 66, a rectangular collar body 136 to which flexible bladder 66 is affixed, a cover 140, and a downwardly depending flexible internal tube 141 reaching to the bottom of flexible bladder 66. Cover 140 is cup-shaped and serves a measuring cup for detergent to be added to the cleaning liquid held within bladder 66. Cover 140 also seals with collar body 136 to prevent air from entering bladder 66 other than through internal tube 141.

Figure 4:
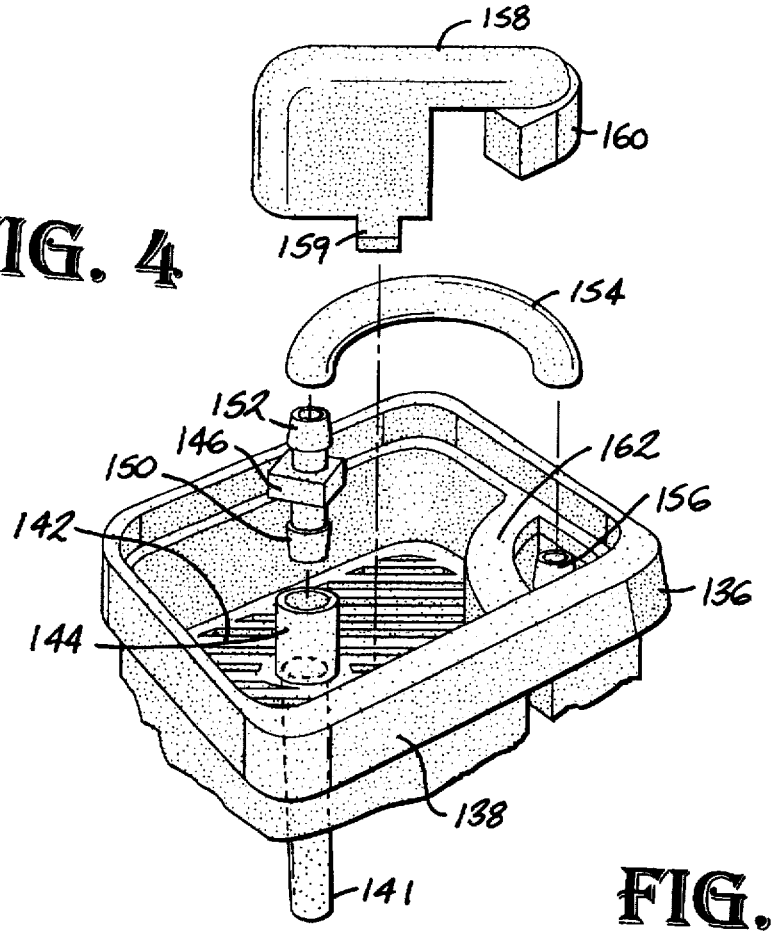
FIG. 4 is an enlarged fragmentary perspective view of a top portion of a flexible bladder assembly.

Collar body 136 is shown in greater detail in FIG. 4. Collar body 136 includes a rectangular peripheral wall 138 with a horizontally extending grated floor 142 extending thereacross. A collar 144 extends through floor 142 to which internal tube 141 is connected. A connector 146 has a pair of nipples 150 and 152 located at either end thereof. Nipple 150 is inserted into collar 144. A first end of a tube 154 is installed over nipple 152. The other end of tube 154 fits over a nipple 156 which is also formed in collar body 136. A protective cover 158 fits over tube 154. Cover 158 has a pair of clips 159 and a wedge shaped end 160. Clips 159 clip to grate openings in grated floor 142 and wedge shaped end 160 fits within a complementary wall 162 formed in collar body 136.

Water can be poured directly through grated floor 142 to fill bladder 66. Thereafter, cover 140 is mounted to the inside of collar body 136 to generally fluidly seal flexible bladder assembly 64 other than the access provided by nipple 156.

Figure 6:
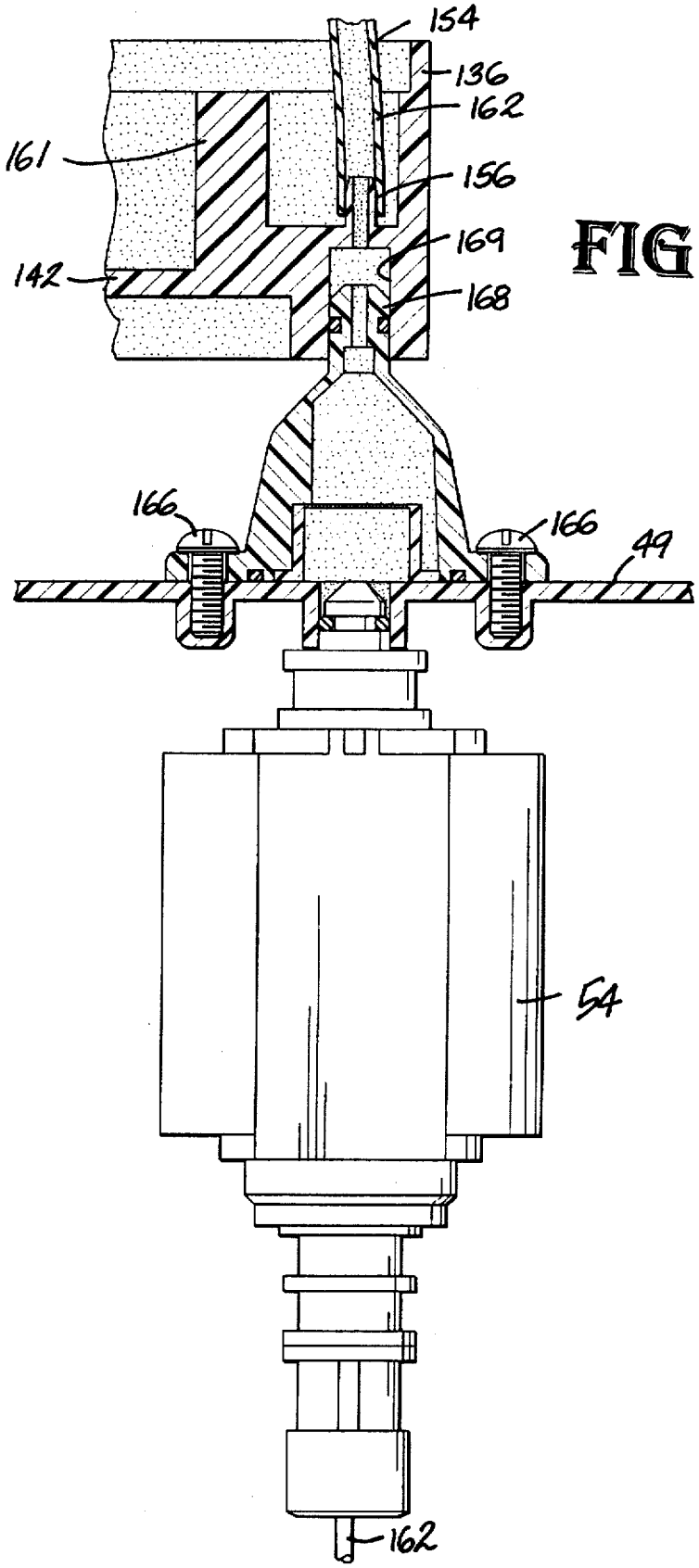
FIG. 6 is an enlarged, fragmentary side view, partially in section, of a fluid pump mounted to a main housing and which is used to pump fluid from the flexible bladder assembly to the hose assembly.

Turning now to FIG. 6, fluid pump 54 is suspended by fasteners 166 from top wall 49. An upstanding nipple 168 fits within a downwardly depending cavity 169 formed in collar body 136 of flexible bladder assembly 64 thereby fluidly connecting flexible bladder assembly 64 to fluid pump 54. The downstream end of fluid pump 54 is attached to a conduit 162. Again, the pathway taken by conduit 162 is schematically indicated in FIG. 2.

Figure 7:
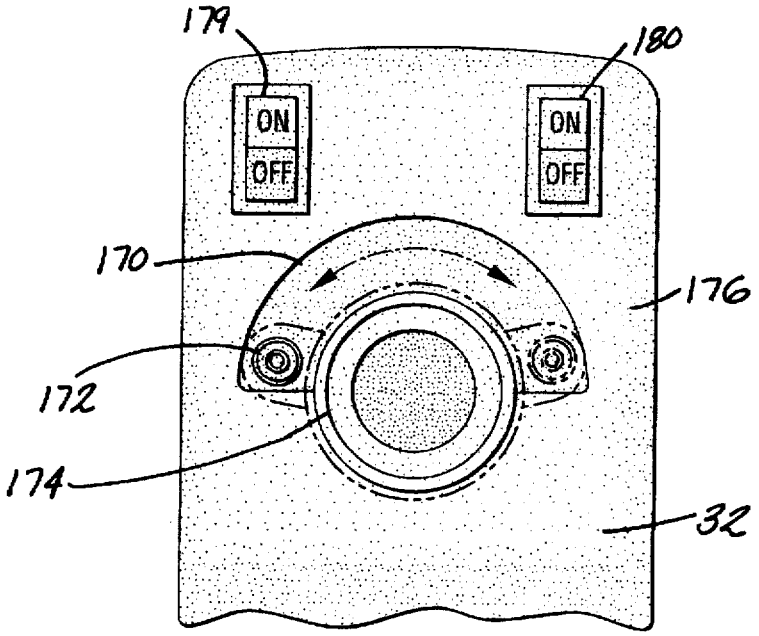
FIG. 7 is a fragmentary view of a swivel mechanism used to swivelably mount the hose assembly to the cover assembly.
Figure 8:
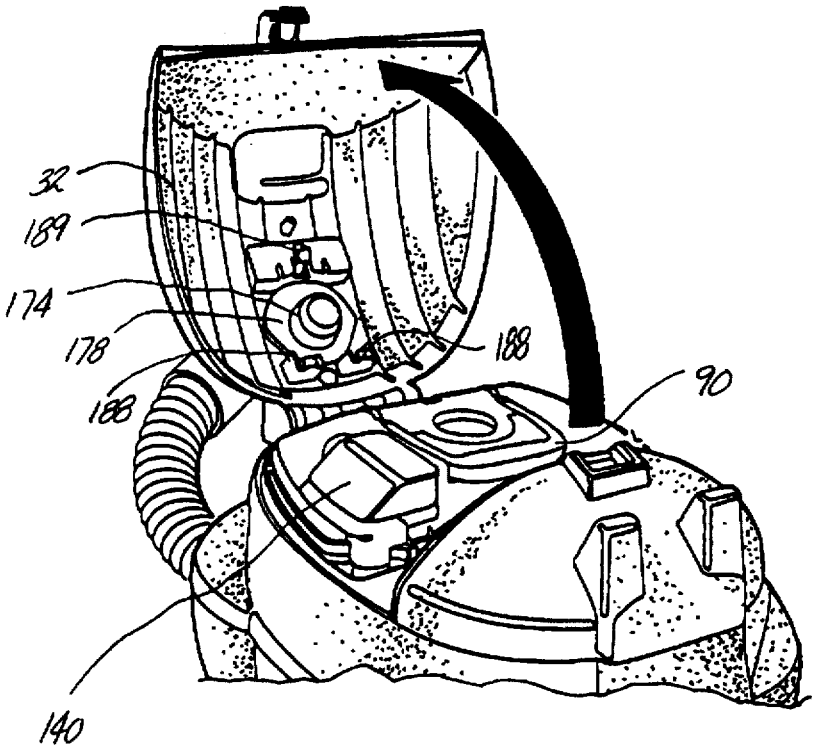
FIG. 8 is a fragmentary perspective view of the vacuum cleaner including the underside of the cover assembly.

Conduit 164 affixes to a connector 172 mounted on a swivel plate 170 which is pivotally mounted to cover assembly 32 of vacuum cleaner 20, as illustrated in FIG. 7. A vacuum hose fitting 174 is formed in swivel plate 170 as well. Swivel plate 170 is captured between an upper plate 176 and a lower plate 178 and rotate through approximately 180 degrees. The bottom end of hose fitting 174 and lower plate 178 can be seen on the underside of cover assembly 32 in FIG. 8. Adjacent swivel plate 170 are a pair of on/off switches 179 and 180 which are used to activate and deactivate motor 50 and fluid pump 54 as desired.

Figure 9:
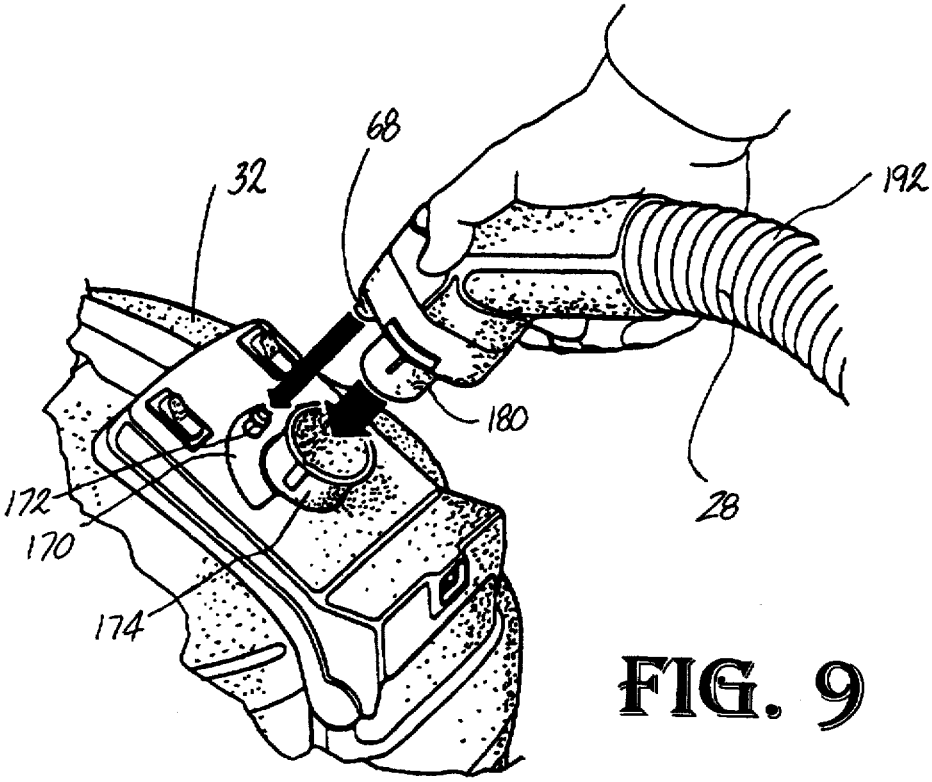
FIG. 9 is a fragmentary perspective view of the hose assembly mounting to the body of the vacuum cleaner.

Looking to FIG. 2, hose fitting 174 is shown extending through a collar 182 disposed on cover assembly 32. A portion of hose fitting 174 extends interiorly of cover assembly 32 and through cover plate 116 sealing inside seal ring 130 to place hose fitting 174 in fluid communication with the interior of recovery tank 60. As shown in FIG. 9, hose assembly 28 attaches to cover assembly 32 with hose 190 fitting over hose fitting 174 and conduit 68 attaching over connector 172.

In a similar fashion, when vacuum bag 24 is used in place of recovery tank 22 in vacuum cleaner 20, hose fitting 174 extends through a rubber seal 184 (FIG. 1) disposed within a rectangular cardboard mounting plate 186. Mounting plate 186 is held in place by clips 188 and 189 molded into the underside of cover assembly 32. When cover assembly 32 is close upon body 18, vacuum bag 24 will reside within tank receiving chamber 40.

Figure 5:
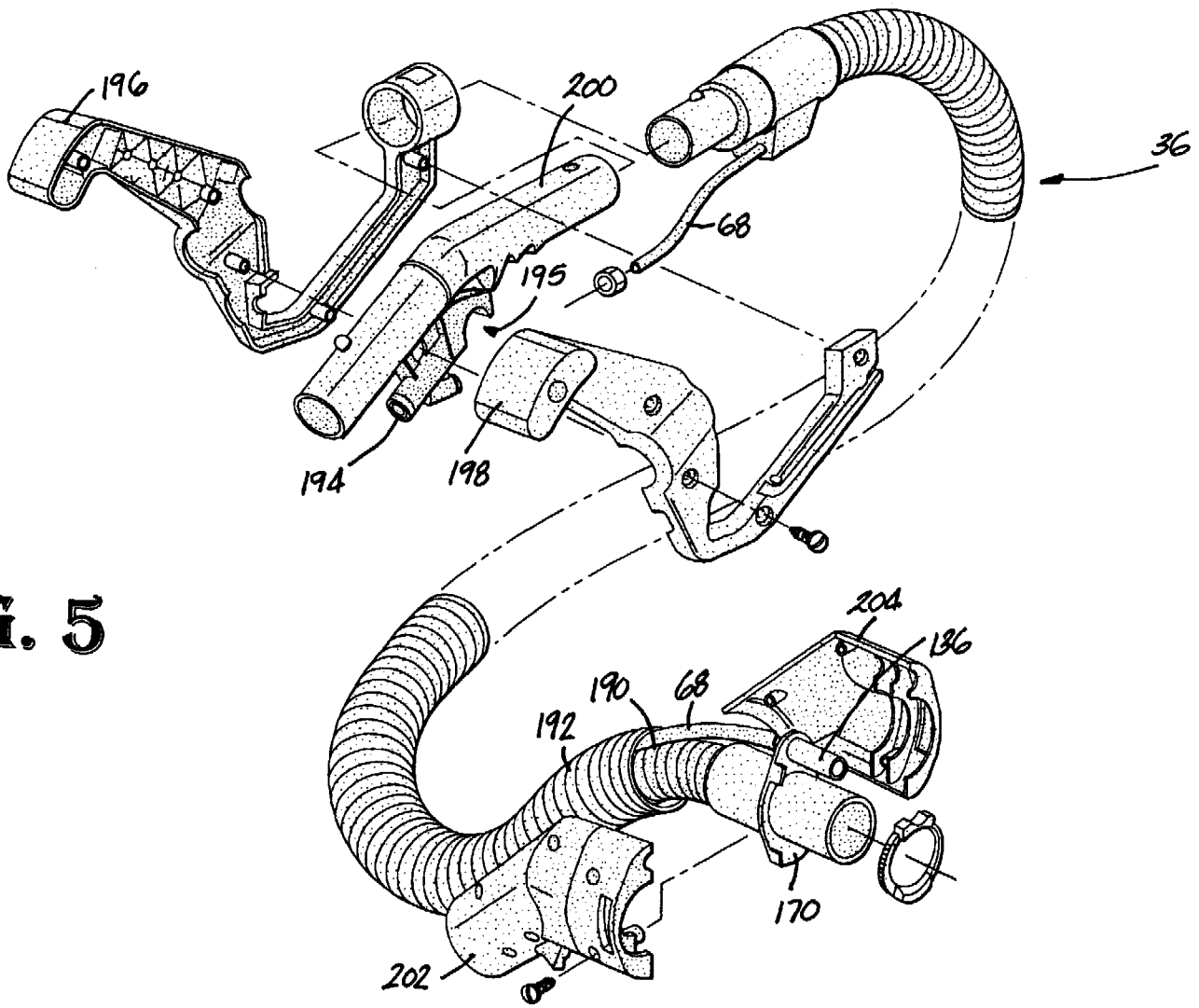
FIG. 5 is an exploded perspective view of a hose assembly employed with the vacuum cleaner.

Hose assembly 36 is shown in greater detail in FIG. 5. Vacuum hose assembly 36 includes an interior vacuum hose 190 disposed within an exterior vacuum hose or sheath 192 with dispensing conduit 68 being threaded and extending along the length of hose assembly 36. The distal end of hose assembly 36 includes a fitting 194 for receiving dispensing conduit 68. A handle mechanism, including handle halves has 196 and 198, clamp about an end piece 200. A plurality of attachments can be mounted to end piece 200 and fitting 194. End piece 200 connects to the end of hose 190. A trigger 195 serves to control the flow of fluid dispensed from fitting 194 onto a surface to be cleaned.

At the proximate end of hose assembly 36, are mounting brackets 202 and 204 which connect to and clamp about a flange located at the end of hose fitting 174. Thus hose assembly 36 can swivel with collar 72 and hose fitting 174. Hose assembly 36 is rotated to one end of the travel of swivel plate 170 when cover assembly 32 is to be opened relative to body 18.

While in the foregoing specification this invention has been described in relation to a certain preferred embodiment thereof, and many details have been set forth for the purpose of illustration, it will be apparent to those skilled in the art that the invention is susceptible to alteration and that certain other details described herein can vary considerably without departing from the basic principles of the invention.

What is claimed is:

1. A vacuum cleaner for cleaning a surface, the vacuum cleaner comprising:

a main housing including a tank chamber;

a motor-blower assembly and a fluid pump mounted within the main housing;

a recovery tank assembly mounted in the tank chamber for storing a contaminated liquid, the recovery tank assembly including a recovery tank and a flexible bladder; and a hose assembly including a vacuum hose and a fluid dispensing conduit for dispensing cleaning liquid on to a floor surface;

the fluid pump in fluid communication with one of the flexible bladder and the recovery tank to pump fluid therefrom to the liquid dispensing conduit; and the other of the flexible bladder and the recovery tank in fluid communication with the vacuum hose and motor-blower assembly so that the vacuum hose may vacuum liquid from the floor surface and into the other of the flexible bladder and the recovery tank.

2. The vacuum cleaner of claim 1 wherein: the flexible bladder is in fluid communication with the fluid pump and the recovery tank is in fluid communication with the vacuum hose.

3. The vacuum cleaner of claim 1 wherein: the flexible bladder is disposed within the recovery tank.

4. The vacuum cleaner of claim 1 further comprising:

a housing cover assembly which mounts upon the main housing, the housing cover assembly having an inlet tube which fluidly seals with the recovery tank assembly when the housing cover assembly is mounted upon the main housing.

5. The vacuum cleaner of claim 4 wherein:

the recovery tank assembly includes a tank cover assembly, the tank cover assembly including a main body with an aperture therein with an elastomeric seal ring in the aperture, the inlet tube passing through the seal ring when the housing cover assembly is mounted upon main housing to effect the fluid seal between the inlet tube and the recovery tank assembly.

6. The vacuum cleaner of claim 5 wherein:

the inlet tube attaches to the vacuum hose of the hose assembly.

7. The vacuum cleaner of claim 4 wherein:

the recovery tank assembly is removable from the tank chamber and a vacuum bag may be disposed in the tank chamber and placed in fluid communication with the vacuum hose and motor-blower assembly.

8. The vacuum cleaner of claim 7 wherein:

the housing cover assembly has a retaining clip therein for retaining the vacuum bag and the vacuum bag has an opening which fluidly connects to the inlet tube.

9. The vacuum cleaner of claim 1 further comprising:

a swivel plate rotatably mounted relative to the housing, the swivel plate including an inlet tube and a dispensing tube, the dispensing conduit and the inlet tube fluidly connecting to the flexible hose and dispensing conduit of the hose assembly;

wherein the hose assembly may swivel with the swivel plate relative to the main housing.

10. A wet/dry vacuum cleaner for cleaning a surface, the vacuum cleaner comprising:

a main housing including a tank chamber;

a motor and blower assembly mounted within the main housing;

a recovery tank assembly removably mountable in the tank chamber for storing a contaminated liquid, the recovery tank assembly including a recovery tank;

a supply tank disposed in the main housing for providing cleaning liquid;

a fluid pump fluidly connecting between the supply tank and a dispensing conduit to pump cleaning liquid on to a surface to be cleaned; and a hose assembly in fluid communication with the recovery tank and motor-blower assembly to vacuum liquid and debris into the recovery tank; and a vacuum bag for collecting dry debris therein;

wherein the recovery tank assembly can be placed in the tank chamber and fluidly connected to the hose assembly to store recovered liquid within the recovery tank in a wet vacuuming mode; or else the vacuum bag may be placed in the tank chamber and in fluid communication with the hose assembly to receive dry debris in a dry vacuuming mode.

11. The vacuum cleaner of claim 10 wherein:

the supply tank is disposed within the recovery tank.

12. The vacuum cleaner of claim 10 wherein:

the supply tank is a flexible bladder.

13. The vacuum cleaner of claim 10 further comprising:

a swivel plate rotatably mounted relative to the main housing, the swivel plate including an inlet tube and a dispensing tube, the dispensing conduit and the inlet tube fluidly connecting to the flexible hose and dispensing conduit of the hose assembly;

wherein the hose assembly may swivel with the swivel plate relative to the main housing.

14. A wet/dry vacuum cleaner convertible between a wet vacuuming mode and a dry vacuuming mode, the vacuum cleaner comprising:

a main housing including a tank chamber;

a recovery tank assembly removably mountable in the tank chamber, the recovery tank assembly including a flexible supply bladder therein for storing cleaning liquid;

a hose assembly for vacuuming a floor surface and fluidly connecting to the tank chamber, the hose assembly including a hose and a dispensing conduit;

a motor-blower assembly and a fluid pump respectively fluidly connecting to the tank chamber and the dispensing tube;

wherein in a wet vacuuming mode, the recovery tank assembly is placed in the tank chamber and in fluid communication with hose assembly and motor-blower assembly to store contaminated liquid; and wherein in a dry vacuuming mode, the vacuum bag is placed in the tank chamber and in fluid communication with the hose assembly and the motor-blower assembly to store dry debris therein.

15. The vacuum cleaner of claim 14 further comprising:

a housing cover assembly mountable to the main housing and to which the hose assembly swivelably attached;

wherein when the housing cover assembly is closed, the hose assembly is automatically placed in fluid communication with the recovery tank assembly when the recovery tank assembly is disposed within the main housing.

16. The vacuum cleaner of claim 15 wherein:

the hose assembly swivelably attaches to the main housing assembly.

* * * * *